US007765717B2

(12) United States Patent
Van Dyck

(10) Patent No.: US 7,765,717 B2
(45) Date of Patent: Aug. 3, 2010

(54) MOISTURIZING FOOTWEAR AND SOLES

(76) Inventor: Stormy Van Dyck, 16626 Blackhawk St., Granada Hills, CA (US) 91344

( * ) Notice: Subject to any disclaimer, the term of this patent is extended or adjusted under 35 U.S.C. 154(b) by 1001 days.

(21) Appl. No.: 11/501,281

(22) Filed: Aug. 9, 2006

(65) Prior Publication Data

US 2008/0034619 A1 Feb. 14, 2008

(51) Int. Cl.
*A43B 7/06* (2006.01)

(52) U.S. Cl. ..... 36/3 B

(58) Field of Classification Search ..... 36/3 B, 36/3 R, 3 AA, 29, 93, 3 A
See application file for complete search history.

(56) References Cited

U.S. PATENT DOCUMENTS

| | | | | |
|---|---|---|---|---|
| 1,260,942 | A * | 3/1918 | Price et al. | 36/3 R |
| 3,417,494 | A * | 12/1968 | Claff | 36/44 |
| 4,835,883 | A * | 6/1989 | Tetrault et al. | 36/3 R |
| 5,185,942 | A * | 2/1993 | Decker | 36/11.5 |
| 5,768,803 | A | 6/1998 | Levy | |
| 5,829,167 | A | 11/1998 | Valenzuela | |
| 5,940,989 | A * | 8/1999 | Liou | 36/3 B |
| 6,792,701 | B1 | 9/2004 | Ruffini et al. | |
| 6,896,667 | B2 | 5/2005 | Carter | |
| 6,922,918 | B2 | 8/2005 | Issler | |
| 2003/0009138 | A1 | 1/2003 | Freeman et al. | |
| 2004/0078996 | A1 * | 4/2004 | Brooks | 36/3 B |
| 2005/0178023 | A1 * | 8/2005 | Hammonds | 36/3 B |
| 2007/0094893 | A1 * | 5/2007 | Flores | 36/11.5 |
| 2007/0261265 | A1 * | 11/2007 | Taylor-Buckner | 36/9 R |
| 2009/0151203 | A1 * | 6/2009 | Boyer et al. | 36/3 B |

FOREIGN PATENT DOCUMENTS

| | | |
|---|---|---|
| EP | 1088489 | 4/2001 |

* cited by examiner

*Primary Examiner*—Ted Kavanaugh
(74) *Attorney, Agent, or Firm*—Edwin Tarver; Lauson & Tarver LLP

(57) ABSTRACT

Footwear for moisturizing a user's feet comprising a multi-layered sole and an upper portion coupled to the sole. The sole includes a top layer, an intermediate layer, a bottom layer and two refillable pouches containing a moisturizing lotion situated between the intermediate and bottom layers at the heel and ball of the foot location. The top and intermediate layers and top surfaces of the pouches include a plurality of apertures, which are in alignment and allow the moisturizing lotion to pass through for contacting the feet of user. The individual soles of the present invention comprise a top layer, a bottom layer, an adhesive layer for sticking the soles to regular footwear and two refillable pouches situated between the top and bottom layers. The top layer and the top surfaces of the pouches include a plurality of apertures for the moisturizing lotion to pass through.

18 Claims, 6 Drawing Sheets

MOISTURIZING FOOTWEAR AND SOLES

CROSS-REFERENCE TO RELATED APPPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to footwear and footwear components, and more particularly to footwear with soles containing moisturizing lotions for moisturizing the feet.

Generally, features such as a good grip, breathability, and appropriate cushioning are built into footwear. Additional or in-built components such as odor absorbing pads and soles with therapeutic properties are also used in conjunction with footwear designs. A variety of designs and materials are used to fabricate footwear in the art.

For example, U.S. Pub. No. 20030009138 to Freeman discloses insole pads, inserts and liners containing plant-derived essential oils and/or dried plant products applied to or constructed within the footwear and footwear components to deliver the comfort, disinfectant and/or therapeutic benefits of aromatherapy through direct contact with the wearer's feet with the volatile components of the plant derived oils and/or plant products.

U.S. Pat. No. 5,829,167 to Valenzuela discloses odor-absorbing pads for shoes, including a flexible housing with breathing apertures formed in its top and bottom surfaces. The bottom layer of the housing is also equipped with an adhesive surface to anchor the pad to the bottom of the interior of a shoe. Each flexible housing is disk shaped, and houses charcoal particles to absorb foot odor, and medicated powder to prevent bacterial and fungal growth.

In U.S. Pat. No. 5,768,803 to Levy, an adjustable support insole system for use in a shoe is disclosed. The system includes a bottom inside layer including a plurality of segments attached to a bottom surface of an insole layer, e.g. the top layer. At least one of the sections may be removed to create an empty space directly beneath a corresponding painful area of a foot. A means is provided for attaching the removable sections.

The above-mentioned references differ from the present invention in that none of them are intended to dispense lotions or oils for a pedicure function. Levy and Valenzuela disclose devices that are structurally as well as functionally distinct from the present invention. Although the structural components of Freeman's footwear appear to be similar, the smaller dispenser pattern and the refilling technology of the present invention distinguish it in the art.

It is therefore an object of the present invention to provide footwear with individual moisturizing soles to moisturize the feet of a user.

A further object is to provide moisturizing footwear and soles, which can be easily manufactured.

A further object is to provide moisturizing footwear and soles that comprise several designs.

Finally, it is an object of the present invention to provide moisturizing footwear and soles, which include refillable pouches for holding moisturizing lotions. These and other objects of the present invention will become better understood with reference to the appended Summary, Description, and Claims.

SUMMARY

The present invention comprises of moisturizing footwear with individual moisturizing soles. The soles of the moisturizing footwear are multilayered in structure and comprise a top layer, an intermediate layer, a bottom layer and two refillable pouches containing a moisturizing lotion. The pouches are situated between the intermediate and bottom layers, and located at the heel and ball of the foot. The intermediate and bottom layers and top surfaces of the pouches include a plurality of apertures through which the moisturizing lotion dispenses to contact the feet of a user. Employing the above structure of the soles, different types of footwear, such as flip flops, slippers, or shoes, can be designed.

The individual soles are similar to the soles of the moisturizing footwear. They comprise a top layer, a bottom layer, an adhesive layer below the bottom layer, a backing layer for covering the adhesive layer and two refillable pouches situated between the top and bottom layers at the heel and ball of the foot location. The top layer and the top surfaces of the pouches include a plurality of apertures for the moisturizing lotion to pass through. The backing layer is peeled of to stick the soles to regular footwear such as shoes, sandals and the like. An alternate embodiment comprises two separate soles, one for the heel and the other for the ball of the foot. Suitable materials can be used for different layers of the individual soles and the soles of the moisturizing footwear.

FIGURES—REFERENCE NUMERALS

Figure 1:
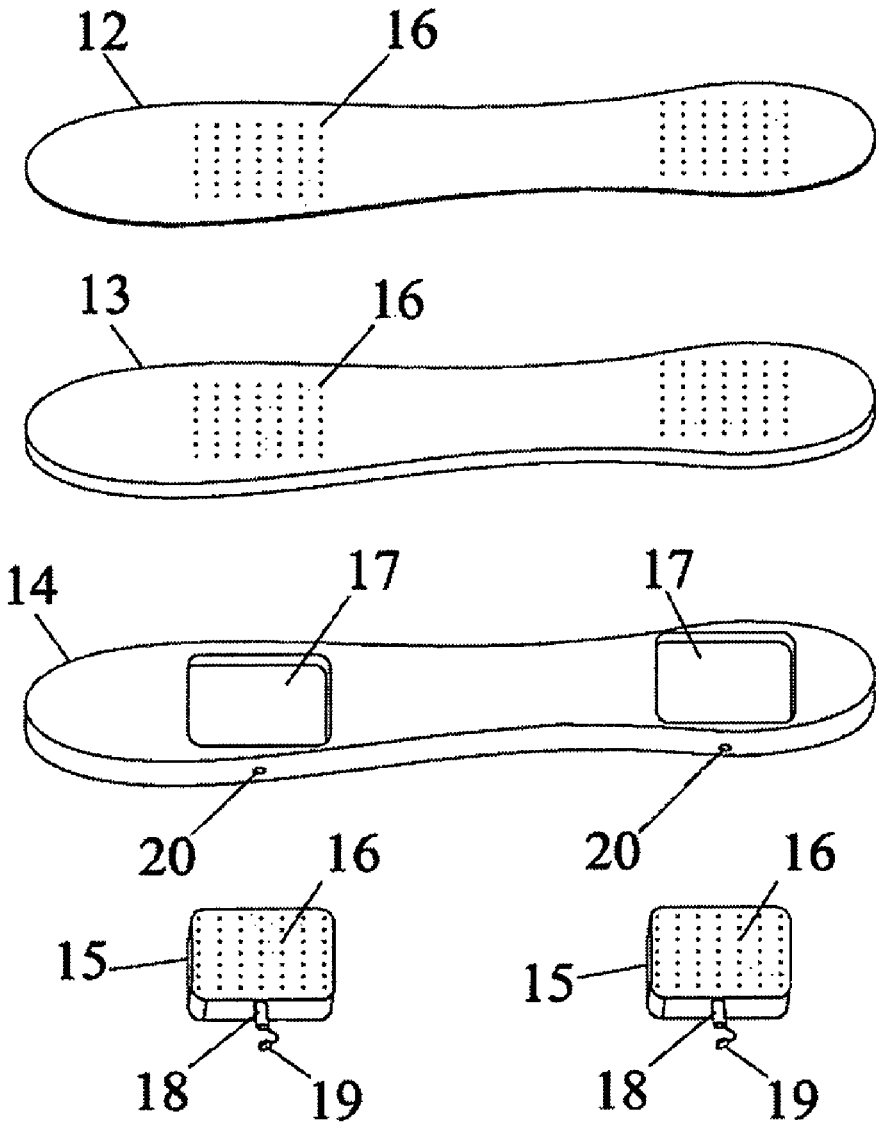
FIG. 1 is an illustration of the moisturizing flip flops in their disassembled condition showing multiple layers and refillable pouches in accordance with the present invention.

10 . . . Footwear with Moisturizing Sole
11 . . . Strap-like Member
12 . . . Top Layer of the Footwear Sole

13 . . . Intermediate Layer of the Footwear Sole
14 . . . Bottom Layer of the Footwear Sole
15 . . . Pouch
16 . . . Aperture
17 . . . Indented Surface
18 . . . Tubular Opening
19 . . . Plug-like Member
20 . . . Hole
21 . . . Alternate Embodiment of the Footwear with Moisturizing Sole
22 . . . . Enclosure
23 . . . Moisturizing Sole
24 . . . Top Layer of the Moisturizing Sole
25 . . . Bottom Layer of the Moisturizing Sole
26 . . . Adhesive Layer
27 . . . Backing Layer
28 . . . Alternate Embodiment of the Moisturizing Sole
29 . . . Slit

DETAILED DESCRIPTION

Referring to the drawings, the preferred embodiments of footwear and footwear soles with moisturizing features are illustrated in FIGS. 1 through 6. The present invention is comprised of a plurality of designs for footwear with moisturizing soles and individual moisturizing soles for use in conjunction with regular footwear.

Figure 2:
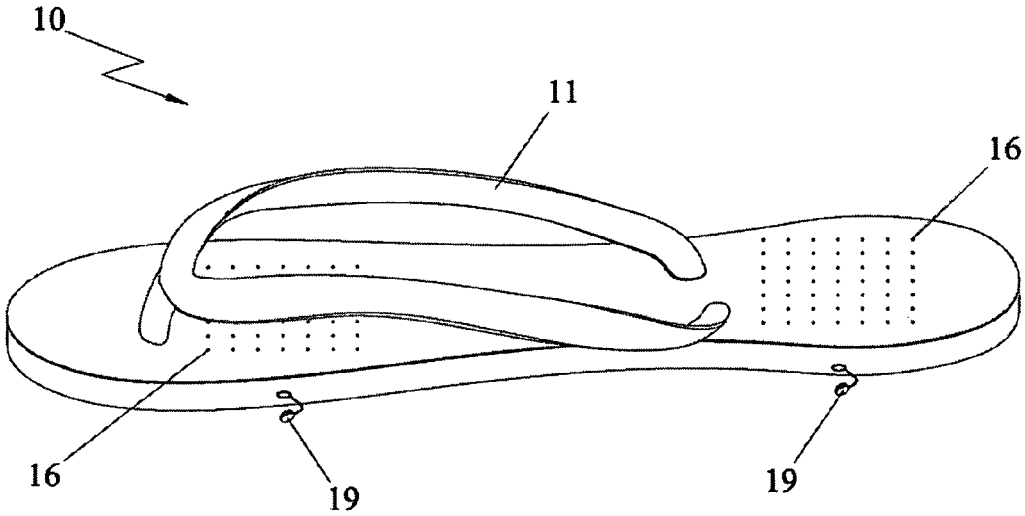
FIG. 2 is an illustration of the moisturizing flip flops in their assembled condition.

Referring to FIGS. 1 and 2, one of the embodiments of the footwear with moisturizing soles 10 is shown. This embodiment is similar to flip flops with strap-like members 11 for holding the foot of a user. The footwear 10 mainly comprises a top layer 12, an intermediate layer 13, a bottom layer 14 and two refillable pouches 15 containing a moisturizing lotion. Both the top and intermediate layers include a plurality of apertures 16 at the heel and ball of the foot location. The bottom layer includes indented surfaces 17 at the heel and ball of the foot location for receiving the pouches 15.

The pouches 15 also include a plurality of apertures 16 on their top surfaces through which the moisturizing lotion can pass through. The pouches 15 further include a tubular opening 18 and a plug-like member 19 to cover the opening 18. Once the moisturizing lotion is depleted, the plug-like member 19 is removed to refill the pouch 15, as seen in FIG. 2. The bottom layer 14 includes holes 20 on its side surface to receive the tubular opening 18 of the pouch. All the layers are assembled after aligning the plurality of apertures 16 on the top layer 12, the intermediate layer 13, and the pouches 15, thereby facilitating the moisturizing lotion to ooze out to contact the feet of the user.

The layers are made of suitable materials, for example, the top layer 12 comprises faux suede material, and the intermediate layer 13 comprises rubber or another resilient material. The bottom layer 14 is the base of the footwear 10 and is made of rubber or a similar durable material for providing a good grip and other desired features.

Figure 3:
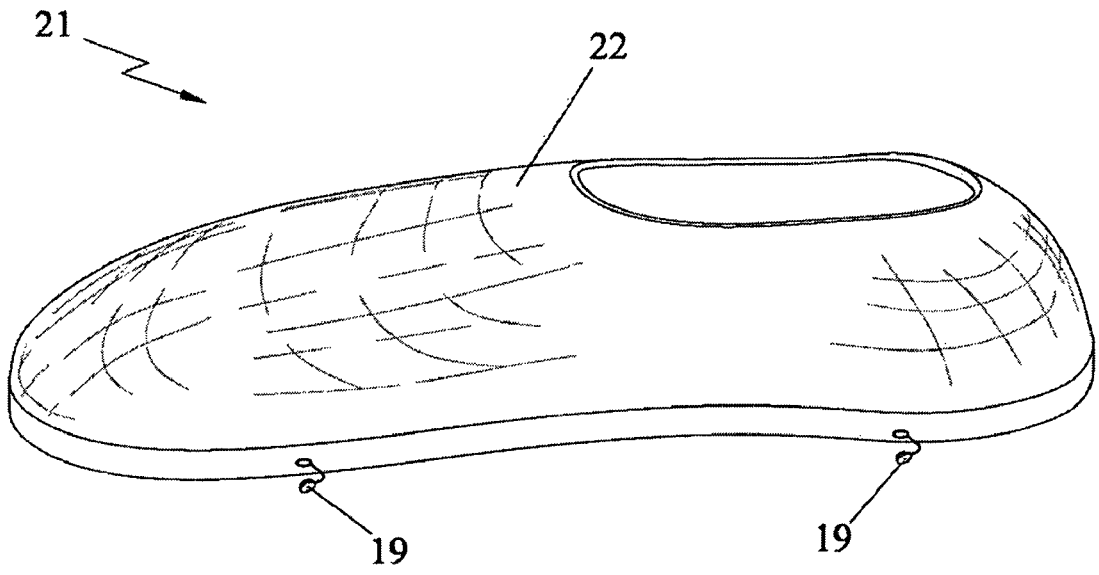
FIG. 3 is an illustration of an alternate embodiment of the moisturizing footwear.

Referring to FIG. 3, an alternate embodiment of the footwear 21 with moisturizing soles is shown. This embodiment is similar to the previous one except that the straps 11 are replaced with an enclosure 22, which can be made of soft suede, terry cloth, or other similar materials. Alternatively, the multi-layered structure along with the moisturizing pouches of the present invention can be employed on other types of footwear such as sandals, shoes, and the like. Also, additional layers can be selected to provide added comfort and cushioning.

Figure 4:
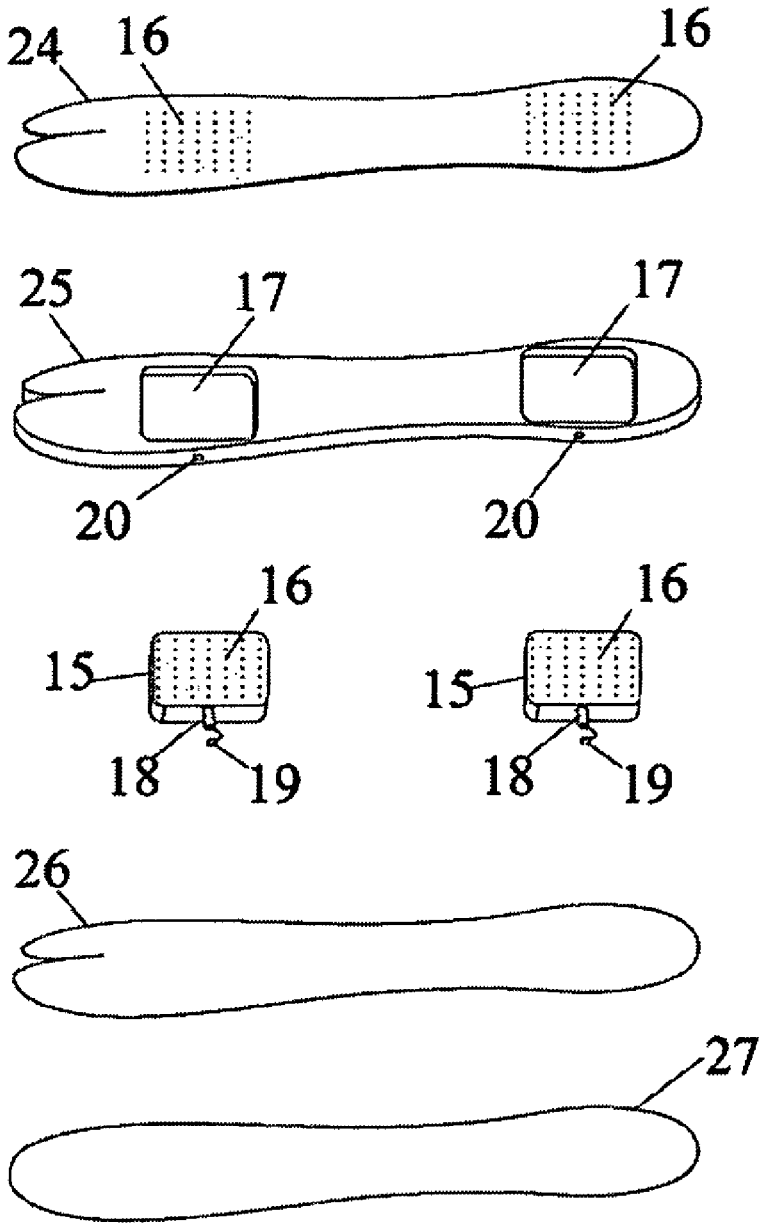
FIG. 4 is an illustration of the single piece moisturizing sole in its disassembled condition showing multiple layers and refillable pouches in accordance with the present invention.
Figure 5:
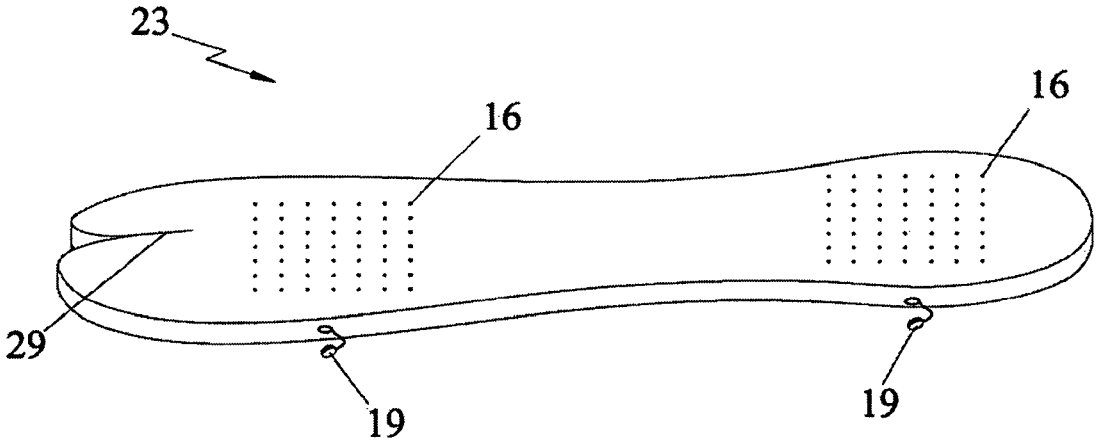
FIG. 5 is an illustration of the single piece moisturizing sole in its assembled condition.

Referring to FIGS. 4 and 5, single piece and individual moisturizing soles 23 for use in conjunction with regular footwear also comprise a multilayered structure. Two refillable pouches 15, a top layer 24, a bottom layer 25, an adhesive layer 26 and a backing layer 27 covering the adhesive layer 26 are the components of the soles 23. The top layer 24 includes a plurality of apertures 16 at the heel and ball of the foot location. The bottom layer 25 includes holes 20 and indented surfaces 17 at the heel and ball of the foot location for receiving the pouches. The pouches 15 used in this embodiment 23 are similar to those used for the embodiments of the footwear with moisturizing soles 10 and 21, which can be refilled with a moisturizing lotion. The components are assembled after aligning the plurality of apertures 16 on the top layer 24 and the pouches 15, thereby facilitating the moisturizing lotion to ooze out to contact the feet of the user.

The backing layer 27 is peeled of to expose the adhesive layer 26, which is then used to adhere the soles 23 to footwear such as a flip flop, sandal, shoe, or the like. The plug-like members 19 on the pouches 15 are removed for refilling. The top layer 24 is made of soft faux suede material and the bottom layer 25 is made of a durable material, such as rubber foam. The soles 23 include a slit 29 in top portion, preferably after the thumb portion, for receiving the meeting portion of the straps of the flip flops.

Figure 6:
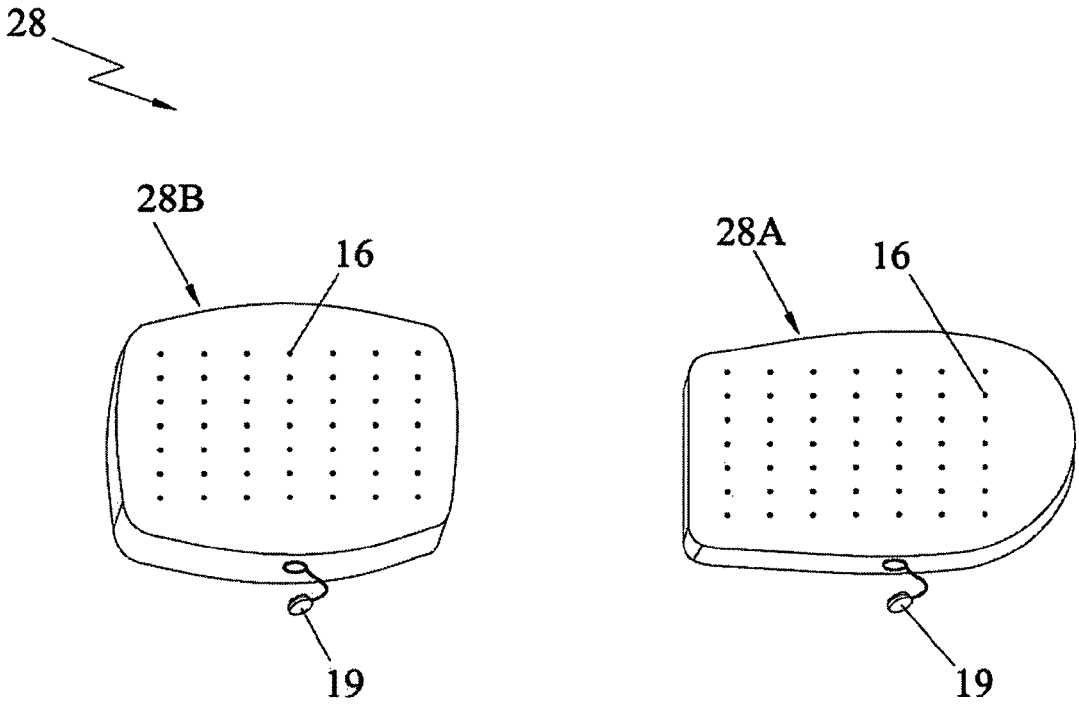
FIG. 6 is an illustration of separate moisturizing soles, one for the heel and the other for the ball of the foot.

Referring to FIG. 6, a second embodiment of the moisturizing soles 28 is comprised of two separate soles, one for the heel 28A and the other for the ball of the foot 28B. The construction of these soles 28A and 28B is similar to the single piece soles 23.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A footwear moisturizing system, comprising:

a. a sole;

b. an upper designed to hold a user's foot; and c. the sole comprising;

i. a top layer having a plurality of apertures;

ii. an intermediate layer having a plurality of apertures;

iii. a bottom layer; and iv. a plurality of refillable pouches each having a plurality of apertures and a tubular opening, said pouches adapted to contain foot care emulsions, wherein a plug-like member seals the tubular opening and may be removed for refilling the pouch, the plurality of pouches being situated between the intermediate and bottom layers, wherein said plurality of apertures on the top layer, intermediate layer and pouches are adapted to cause said emulsions to contact the feet of a user in an amount insufficient to cause slippage when the footwear is in use.

2. The footwear of claim 1, wherein the intermediate and bottom layers comprise spaces to accommodate the plurality of pouches without increasing the thickness of the footwear.

3. The footwear of claim 1, wherein the plurality of apertures are located in the heel area and the ball area, respectively of the sole, a first pouch being situated in the heel area, and a second pouch being situated in the ball area of the foot.

4. The footwear of claim 2, wherein the bottom layer includes indented surfaces for accommodating the first and second pouches.

5. The footwear of claim 1, wherein the pouches include an opening accessible from the exterior of the footwear and through which the pouches may be refilled with the moisturizing lotion.

6. The footwear of claim 1, wherein the footwear comprises footwear chosen from the list of flip-flops, slippers, and sandals.

7. The footwear of claim 1, wherein the upper comprises two straps.

8. The footwear of claim 1, wherein the upper substantially covers the user's feet and is made of a material derived from the list of leather derived and cloth derived products.

9. The footwear of claim 1, wherein the top layer is made of faux suede material.

10. The footwear of claim 1, wherein the intermediate layer is made of a flexible resilient materials.

11. A footwear sole for moisturizing the feet, comprising:

a top layer having a plurality of apertures;

a bottom layer; and a plurality of refillable pouches including a plurality of apertures on their top surfaces wherein said pouches contain a moisturizing lotion, the pouches being situated between the top and bottom layers; and the plurality of apertures on the pouches and the plurality of apertures on the top layer being adapted for the moisturizing lotion to pass through to the feet of a user when walking, in an amount insufficient to cause slippage.

12. The footwear sole of claim 11 wherein the top and bottom layers accommodate the plurality of pouches without an increase in thickness.

13. The footwear sole of claim 12 wherein the plurality of apertures are located in a first pouch situated in the heel area and a second pouch situated in the ball area of a user's foot, respectively.

14. The footwear sole of claim 12 wherein the bottom layer includes indented surfaces for accommodating the first and second pouches.

15. The footwear sole of claim 11 wherein the pouches include an opening accessible on the exterior of the footwear and through which the pouches may be refilled with moisturizing lotion.

16. The footwear sole of claim 11 wherein a plug-like member is used to seal the opening and is removed for refilling the pouch.

17. The footwear sole of claim 11 wherein the top layer is made of faux-suede material.

18. The footwear sole of claim 11 wherein the bottom layer is made of rubber foam.

* * * * *